US012379182B2

(12) United States Patent
Pasquale

(10) Patent No.: US 12,379,182 B2
(45) Date of Patent: Aug. 5, 2025

(54) AIR RIFLE DEVICE

(71) Applicant: Ryan Pasquale, New Brighton, PA (US)

(72) Inventor: Ryan Pasquale, New Brighton, PA (US)

( * ) Notice: Subject to any disclaimer, the term of this patent is extended or adjusted under 35 U.S.C. 154(b) by 0 days.

(21) Appl. No.: 18/537,209

(22) Filed: Dec. 12, 2023

(65) Prior Publication Data

US 2025/0189264 A1 Jun. 12, 2025

(51) Int. Cl.

| | |
|---|---|
| ***F41B 11/62*** | (2013.01) |
| ***F41B 11/723*** | (2013.01) |
| ***F41G 1/02*** | (2006.01) |
| ***F41G 1/06*** | (2006.01) |

(52) U.S. Cl.

CPC ..... *F41B 11/62* (2013.01); *F41B 11/723* (2013.01); *F41G 1/02* (2013.01); *F41G 1/06* (2013.01)

(58) Field of Classification Search

CPC ..... F41B 11/62; F41B 11/723; F41B 11/00; F41B 11/60; F41B 11/70; F41G 1/02; F41G 1/06; F41A 1/04

See application file for complete search history.

(56) References Cited

U.S. PATENT DOCUMENTS

| | | | | |
|---|---|---|---|---|
| 5,103,366 | A | 4/1992 | Battochi | |
| 6,615,815 | B1 | 9/2003 | Liang | |
| 8,739,770 | B2 | 6/2014 | Masse | |
| 10,801,804 | B2 * | 10/2020 | Sandgren | F41B 11/50 |
| 11,609,063 | B1 * | 3/2023 | Wei | F41B 11/64 |
| 11,680,770 | B2 * | 6/2023 | Buys | F41B 11/723 124/74 |
| 2004/0031382 | A1 * | 2/2004 | Ogram | F41B 11/62 89/7 |
| 2006/0032487 | A1 * | 2/2006 | Tippmann, Sr. | F41A 1/04 124/74 |
| 2008/0017179 | A1 | 1/2008 | Vasel | |
| 2010/0170492 | A1 | 7/2010 | Tiberius | |
| 2014/0060509 | A1 * | 3/2014 | Tseng | F41A 9/67 124/40 |
| 2015/0007804 | A1 * | 1/2015 | Tippmann, Jr. | F41B 11/70 124/73 |
| 2015/0300770 | A1 * | 10/2015 | Tseng | F41B 11/62 124/75 |

(Continued)

FOREIGN PATENT DOCUMENTS

| | | | | |
|---|---|---|---|---|
| EP | 0631658 | | 1/1995 | |
| JP | 06094394 A | * | 4/1994 | F41B 11/55 |

*Primary Examiner* — Benjamin P Lee

(57) ABSTRACT

An air rifle device for using a cylinder of carbon dioxide as a propellant includes a housing having a front end, a rear end, a top side, and a bottom side defining a chamber extending through the housing. A barrel coupled to the front end is in fluid communication with the chamber. A clip removably couplable to the housing holds a plurality of projectiles. A canister removably mounted to the housing holds a propellant. The canister comprises a neck and a body. A collar configured to receive the neck is mounted to the housing. A cradle configured to receive the body is coupled to the housing. The cradle is aligned with the collar to facilitate coupling the canister to the collar. A trigger mechanism mounted to the housing expels a quantity of the propellant into the barrel sufficient to propel one of the plurality of projectiles outwardly through the barrel.

18 Claims, 11 Drawing Sheets

(56) References Cited

U.S. PATENT DOCUMENTS

| | | | | |
|---|---|---|---|---|
| 2018/0142984 | A1* | 5/2018 | Harvey | F41B 11/62 |
| 2018/0202752 | A1* | 7/2018 | Buys | F41B 11/55 |
| 2018/0202753 | A1* | 7/2018 | Willson | F41B 11/00 |
| 2019/0390933 | A1* | 12/2019 | Tran | F41C 23/04 |
| 2020/0025510 | A1* | 1/2020 | Sandgren | F41A 33/06 |
| 2020/0182585 | A1* | 6/2020 | Tasyagan | F41B 11/73 |
| 2022/0196358 | A1* | 6/2022 | Tasyagan | F41A 9/61 |
| 2022/0236031 | A1* | 7/2022 | Sandgren | F41B 11/56 |
| 2024/0159492 | A1* | 5/2024 | Axelsson | F41B 11/60 |
| 2024/0263912 | A1* | 8/2024 | Axelsson | F41B 11/723 |

* cited by examiner

AIR RIFLE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to air-powered guns and more particularly pertains to a new air-powered gun for using a pneumatic cylinder of carbon dioxide as a propellant.

(2) Description of Related Art Including Information Disclosed Under 37 CFR 1.97 and 1.98

The prior art relates to air-powered guns. Typically, air-powered guns use small canisters of compressed gas to provide propulsive energy to fire the projectiles. For example, a typical air-powered gun may use a 12-gram carbon dioxide cylinder. The small size of these cylinders significantly limits the propulsive force of the projectiles, the distance over which the projectiles can be shot, the number of projectiles that can be fired, and the size of the projectiles that can be fired. In turn, these limitations limit the efficiency of an air-powered gun for hunting and self-defense purposes. The small size of cylinders also increases the cost of air-powered guns because a user needs to regularly replace the small cylinders. Thus, there is a need in the art for an air-powered gun that can use a cylinder with a larger volume of compressed gas as the propellant.

BRIEF SUMMARY OF THE INVENTION

An embodiment of the disclosure meets the needs presented above by generally comprising a housing having a front end, a rear end, a top side, and a bottom side. The top side and the bottom side are coupled to and extend between the front end and the rear end to define a chamber extending through the housing. A barrel is coupled to the front end. The barrel has a muzzle end distal to the front end of the housing.

The muzzle end defines an opening extending into the barrel. The chamber is in fluid communication with the barrel. A clip is removably couplable to the housing. The clip is in fluid communication with the chamber. The clip houses a plurality of projectiles. A canister is removably mounted to the housing. The canister is fluidly couplable to the chamber. The canister houses a propellant. The canister has a capacity between 30.0 grams and 60.0 grams. The canister comprises a neck and a body. A collar is mounted to the housing. The collar is configured to receive the neck of the canister. A cradle is coupled to the housing. The cradle has a shape that is complementary to a shape of the body of the canister wherein the cradle is configured to receive the canister. The cradle is aligned with the collar wherein the cradle is configured to facilitate coupling the canister to the collar whereby the neck of the canister is couplable with the collar when the body of the canister is positioned within the cradle. A trigger mechanism is mounted to the housing. The trigger mechanism expels a quantity of the propellant into the barrel. The quantity of propellant is sufficient to propel a one of the plurality of projectiles forwardly through the chamber into the barrel and outwardly through the muzzle end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
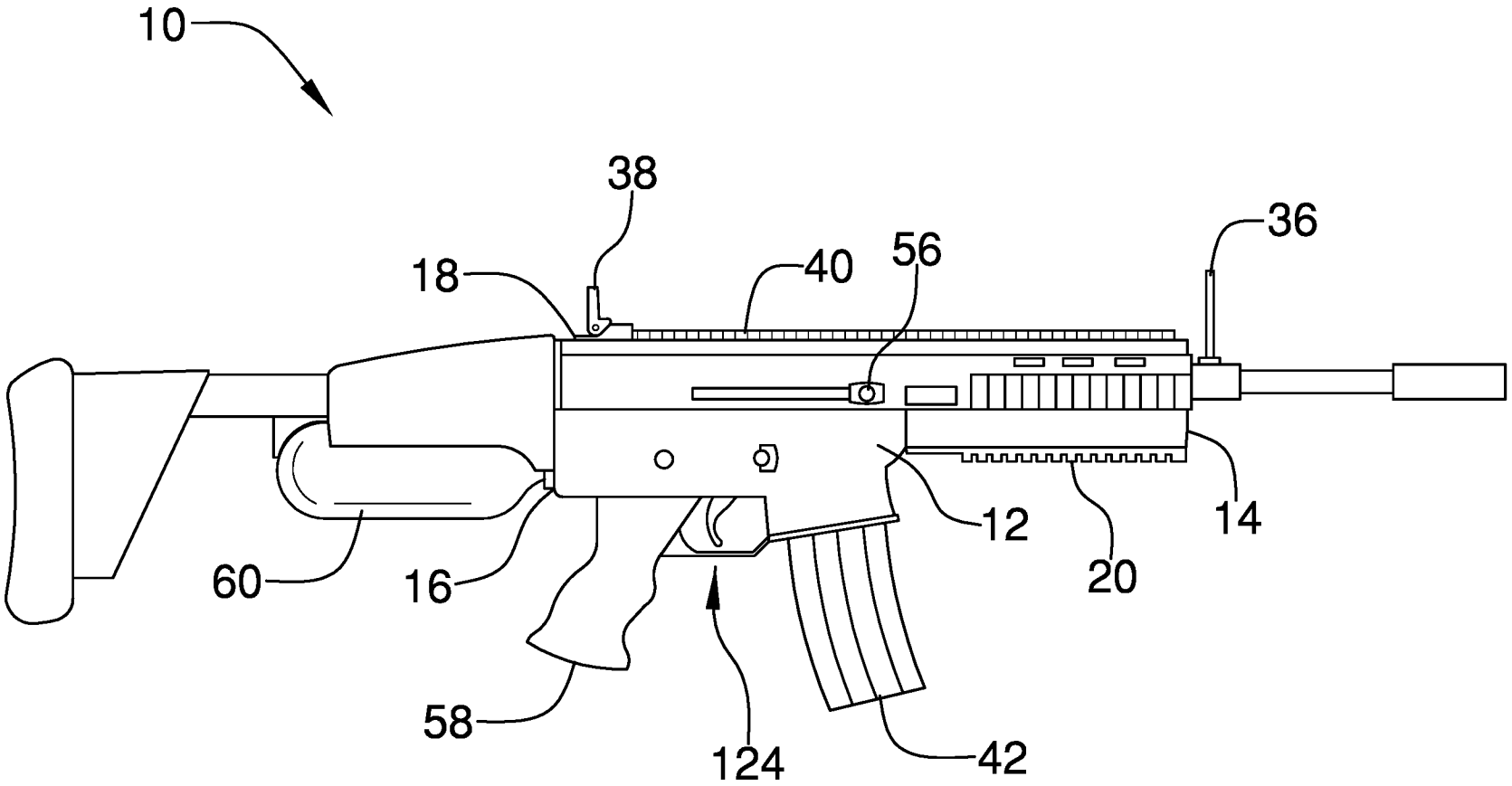
FIG. 1 is a front view of an air rifle device according to an embodiment of the disclosure.
Figure 2:
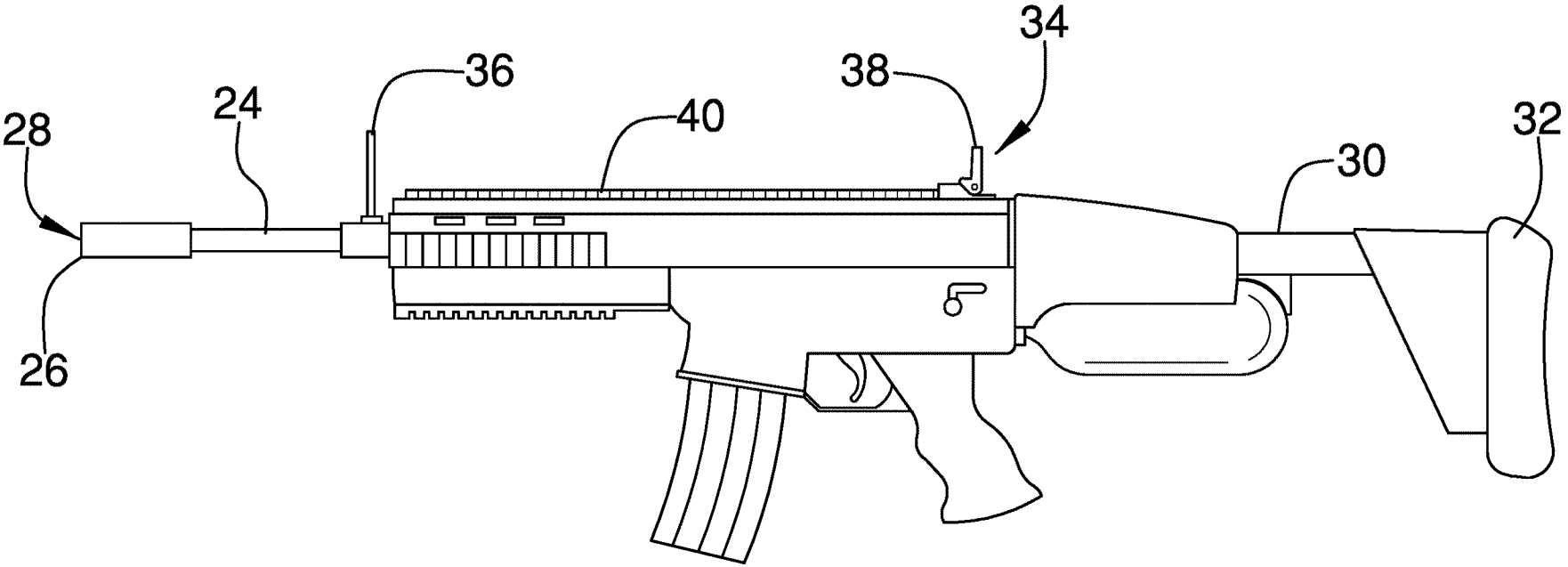
FIG. 2 is a rear view of an embodiment of the disclosure.
Figure 3:
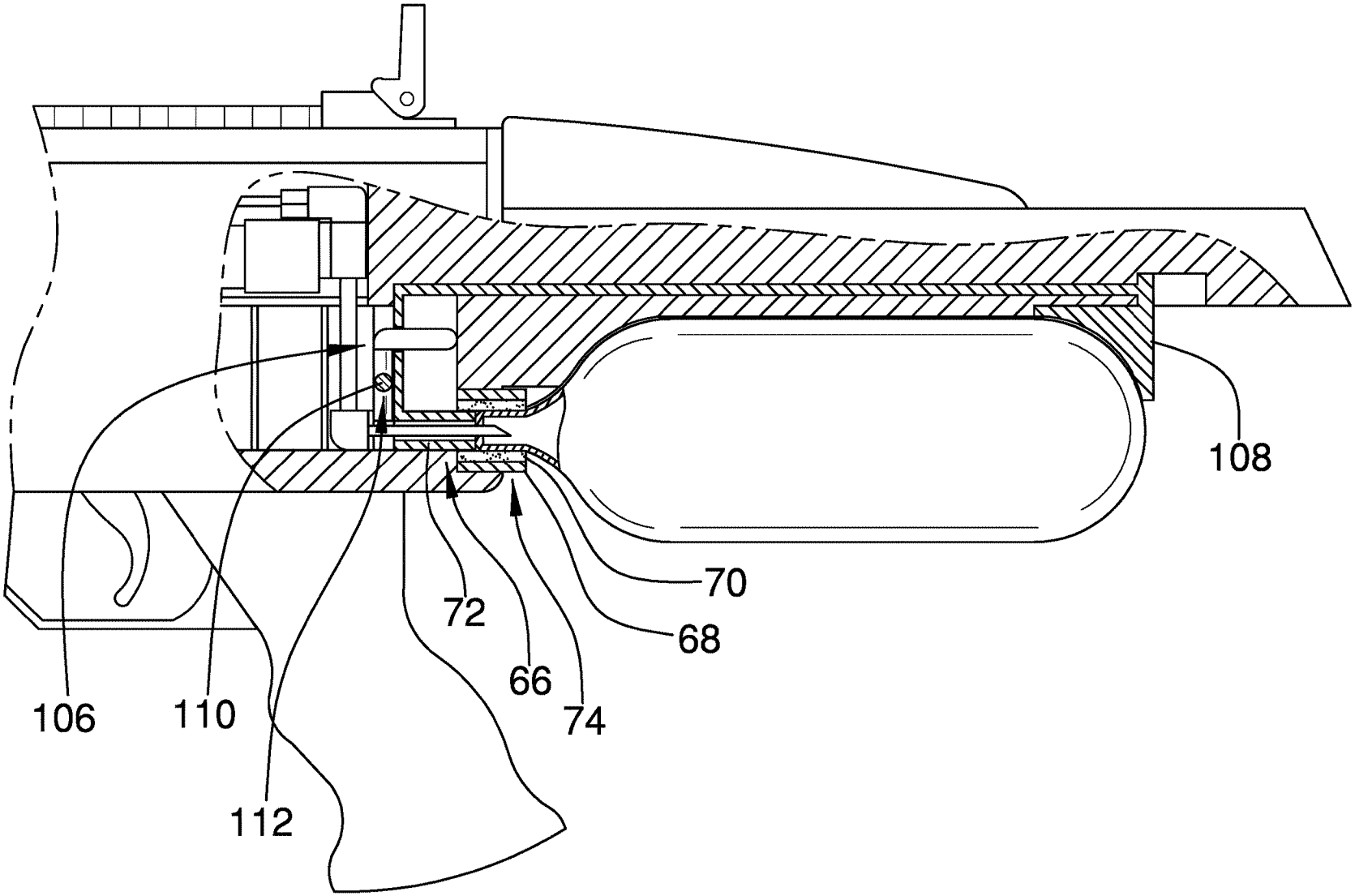
FIG. 3 is a cross-sectional view of an embodiment of the disclosure.
Figure 4:
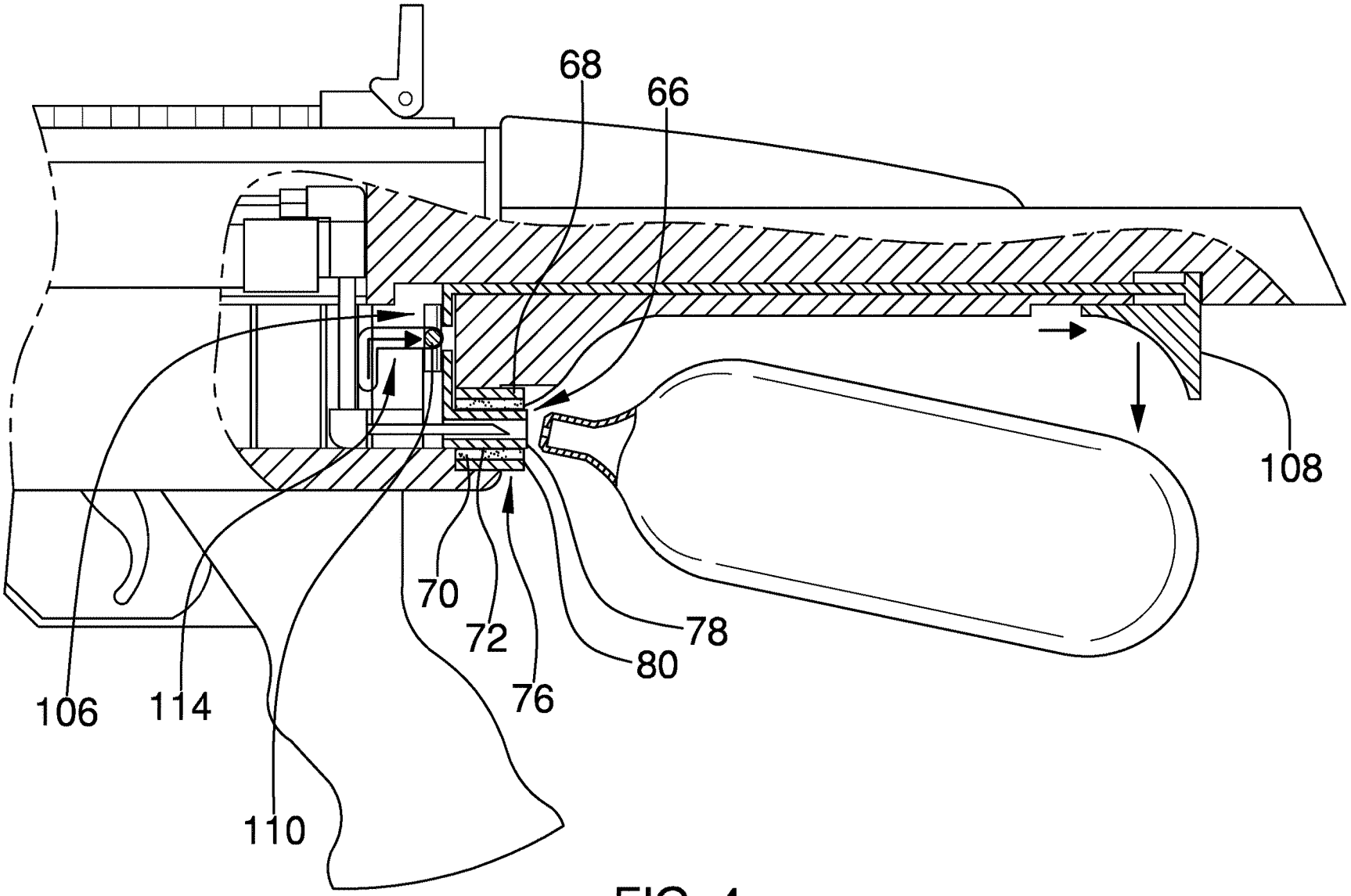
FIG. 4 is a cross-sectional view of an embodiment of the disclosure.
Figure 5:
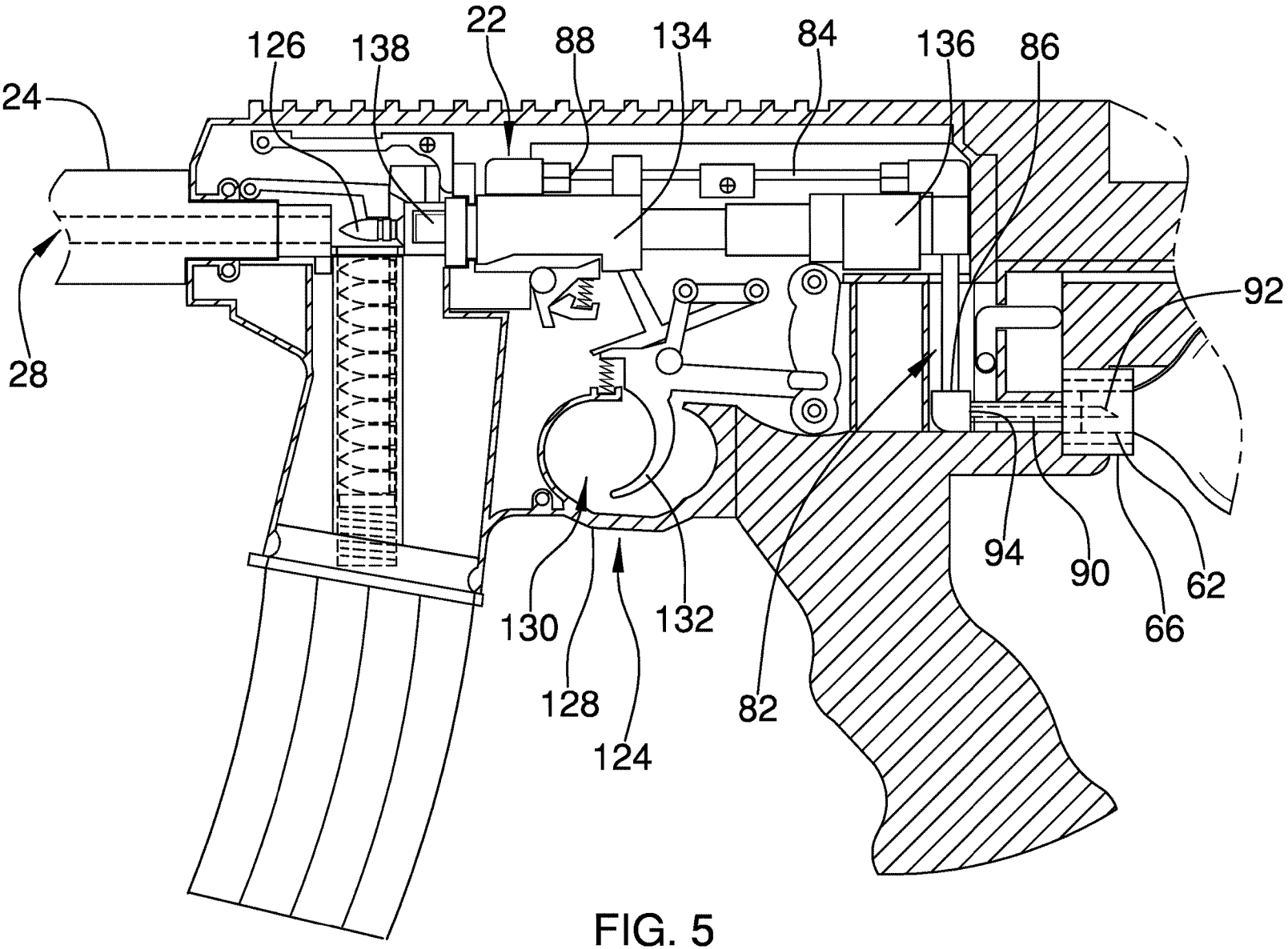
FIG. 5 is a cross-sectional view of an embodiment of the disclosure.
Figure 6:
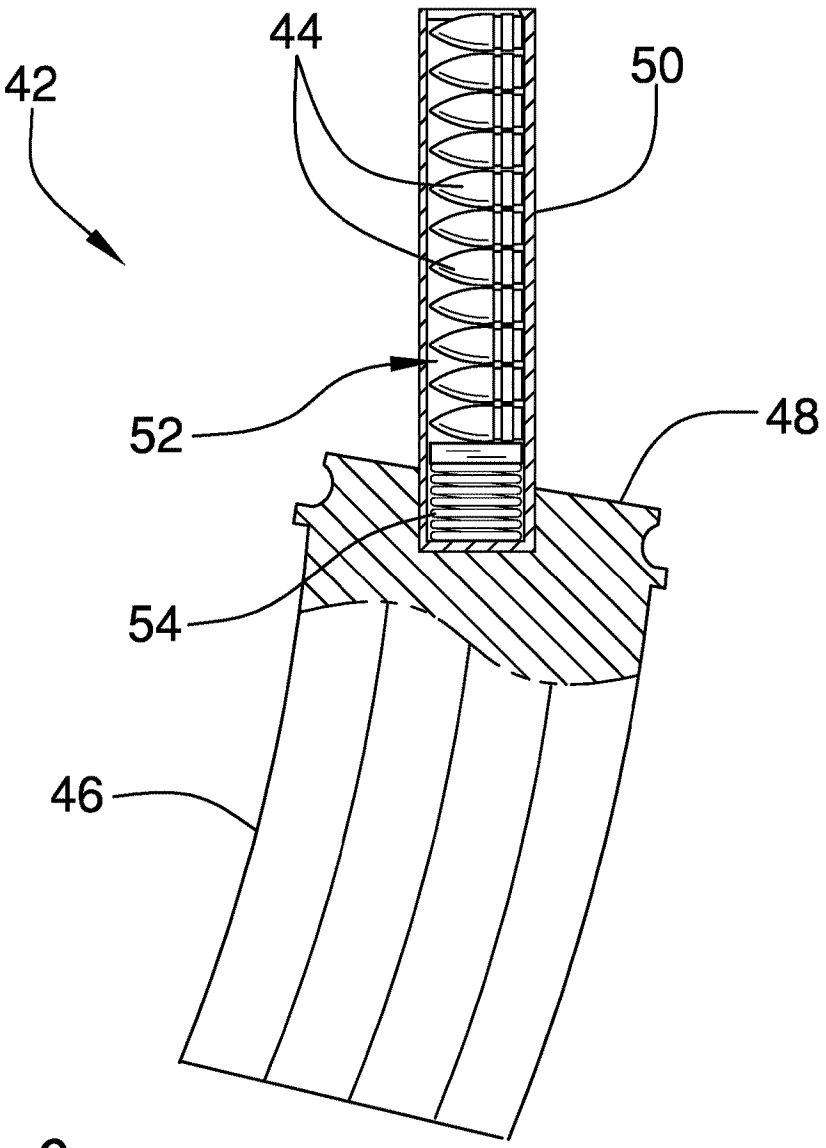
FIG. 6 is a cross-sectional view of an embodiment of the disclosure.
Figure 7:
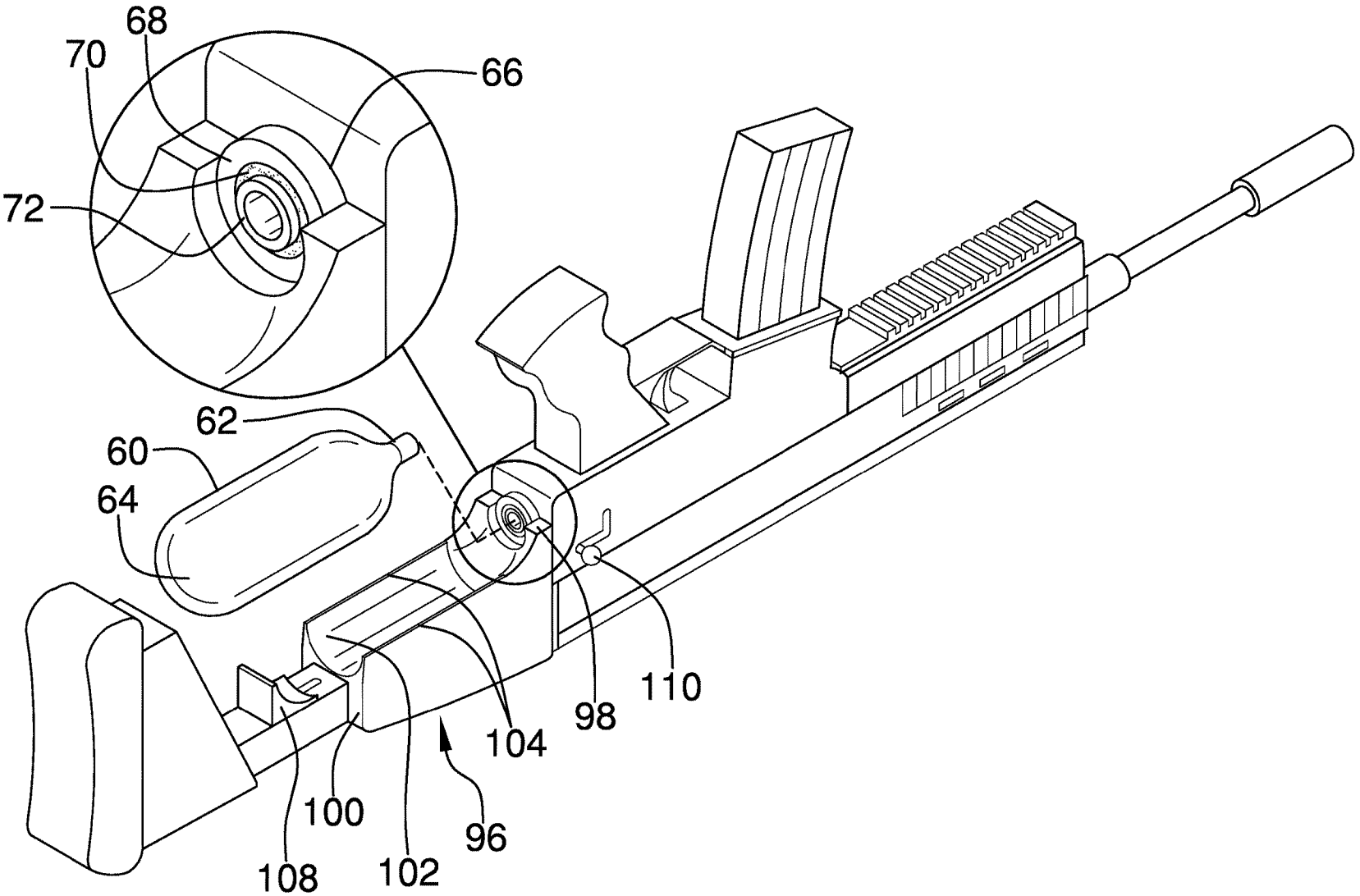
FIG. 7 is a bottom isometric view of an embodiment of the disclosure.
Figure 8:
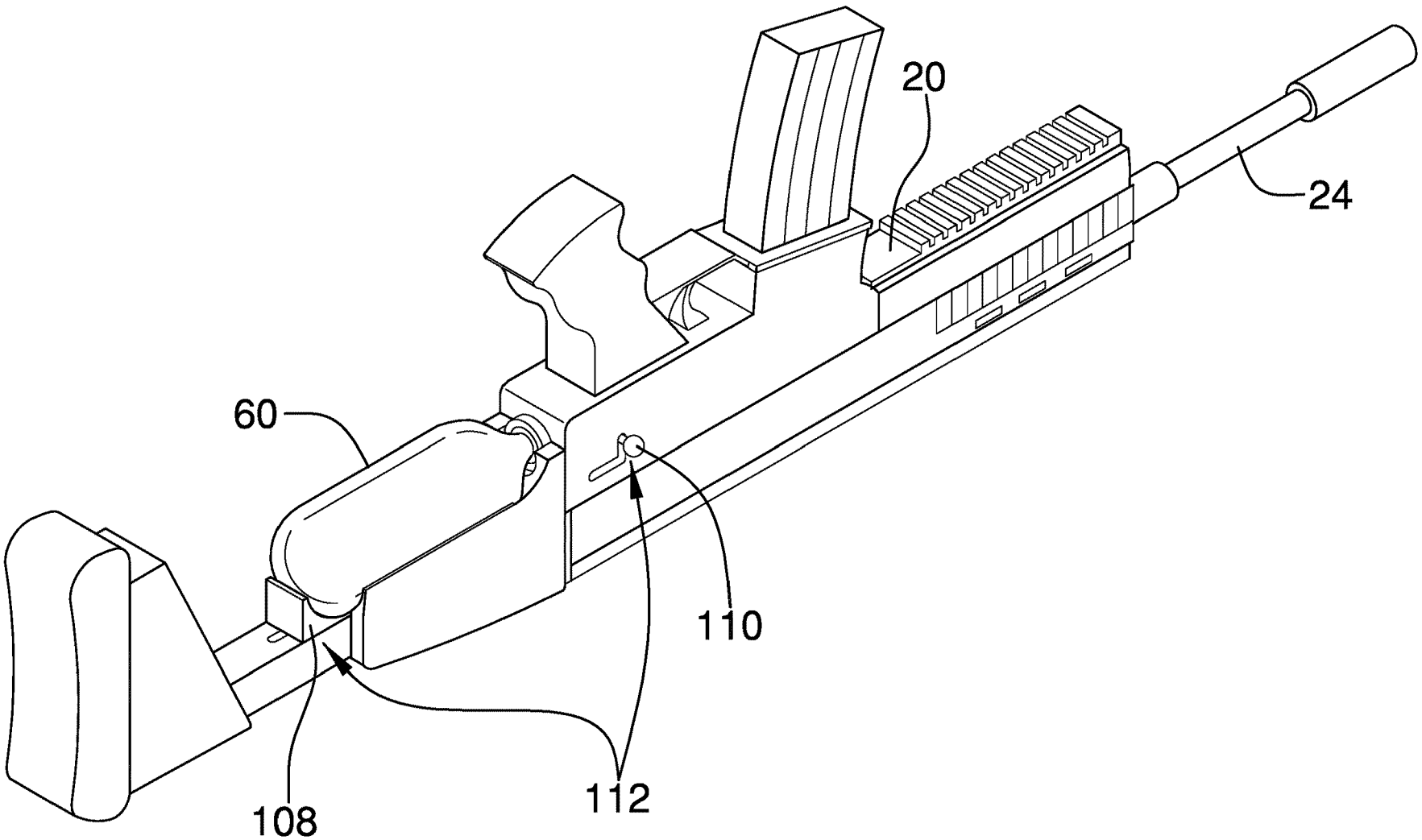
FIG. 8 is a bottom isometric view of an embodiment of the disclosure.

With reference now to the drawings, and in particular to FIGS. 1 through 11 thereof, a new air-powered gun embodying the principles and concepts of an embodiment of the disclosure and generally designated by the reference numeral 10 will be described.

As best illustrated in FIGS. 1 through 11, the air rifle device 10 generally comprises a housing 12 having a front end 14, a rear end 16, a top side 18, and a bottom side 20. The top side 18 and the bottom side 20 are coupled to and extend between the front end 14 and the rear end 16 to define a chamber 22 extending through the housing 12.

A barrel 24 is coupled to the front end 14. The barrel 24 may extend outwardly from the front end 14. The barrel 24 includes a muzzle end 26 that is distal to the front end 14 of the housing 12. The muzzle end 26 defines an opening 28 extending into the barrel 24. The chamber 22 is in fluid communication with the opening 28 of the barrel 24.

A stock 30 may be coupled to the housing 12. The stock 30 is generally configured to abut a user for steadying the housing 12 and the barrel 24. A recoil pad 32 may be coupled to the stock 30 distal to the housing 12. The recoil pad 32 is generally configured to absorb recoil and increase friction between the stock 30 and a shoulder of the user when the barrel 24 is aimed at a target.

A scope 34 may be mounted to the housing 12. The scope 34 is configured to align the front end 14 with the rear end 16 wherein the scope 34 is configured to align the muzzle end 26 with the target when the barrel 24 is aimed at the target. Embodiments of the scope 34 may include a front sight 36 that extends upwardly from the front end 14. For example, the front sight 36 may be positioned on the top side 18 proximate to the barrel 24. Embodiments of the scope 34 may also include a rear sight 38 that extends upwardly from the rear end 16. For example, the rear sight 38 may be positioned on the top side 18 proximate to the stock 30. The rear sight 38 is generally spaced from the front sight 36. A rail 40 may extend along the top side 18 of the housing 12 between the front sight 36 and the rear sight 38, or between the front end 14 and the rear end 16. The rail 40 is generally configured to receive a scope mount.

A clip 42 may be removably couplable to the housing 12. The clip 42 is generally in fluid communication with the chamber 22. For example, the clip 42 may extend downwardly from the bottom side 20 of the housing 12. The clip 42 houses a plurality of projectiles 44. For example, the clip 42 may house between 20 and 30 projectiles. Each of the plurality of projectiles 44 may be between 20 and 40 caliber, for example the plurality of projectiles 44 may be 30 caliber. The plurality of projectiles 44 may each have a weight between 65.0 grain and 135.0 grain.

Embodiments of the clip 42 may include a first magazine 46 that has an upper end 48 that is positionable within the chamber 22. A second magazine 50 may be coupled to the upper end 48. The second magazine 50 may have an inner recess 52 that is configured to receive the plurality of projectiles 44. The plurality of projectiles 44 may be stacked on top of each other along a longitudinal plane within the inner recess 52. A pellet spring 54 may be positioned within the inner recess 52 proximate to the upper end 48 of the first magazine 46. The pellet spring 54 may be compressed by a weight of the plurality of projectiles 44 and may expand as each of the plurality of projectiles 44 is propelled outwardly from the barrel 24. The pellet spring 54 generally urges the plurality of projectiles 44 upwardly toward the chamber 22.

A cocking lever 56 may be coupled to the housing 12. The cocking lever 56 is actuatable to release a one of the plurality of projectiles 126 from the inner recess 52 of the second magazine 50 into the chamber 22. The one of the plurality of projectiles 126 is aligned with the barrel 24 when the one of the plurality of projectiles 126 is released from the second magazine 50 into the chamber 22.

A grip 58 may extend downwardly from the bottom side 20 of the housing 12. The grip 58 is generally configured to facilitate the user in holding the housing 12. The grip 58 may be positioned proximate to the rear end 16.

A canister 60 is removably mounted to the housing 12. The canister 60 is fluidly couplable to the chamber 22. The canister 60 houses, or holds, a propellant. For example, the propellant may be carbon dioxide, which is generally compressed within the canister 60. Such embodiments of the canister 60 may be a pneumatic cylinder of the carbon dioxide. The canister 60 may have a capacity between 20.0 grams and 70.0 grams. The canister 60 generally comprises a neck 62 and a body 64.

A collar 66 is mounted to the housing 12. The collar 66 is configured to receive the neck 62 of the canister 60. Embodiments of the collar 66 comprise a docking collar 68 that is positioned on the bottom side 20 of the housing 12. A seal 70 is coupled to the docking collar 68. The seal 70 is positioned within the docking collar 68. The seal 70 seals the canister 60 with the housing 12 thereby inhibiting the propellant from being released from the canister 60 through the collar 66.

An ejecting collar 72 may be positioned within the seal 70. The ejecting collar 72 may have a retracted position 74 and an extended position 76. A free end 78 of the ejecting collar 72 may be positioned within the docking collar 68 when the ejecting collar 72 is in the retracted position 74. The retracted position 74 is configured to couple the canister 60 to the collar 66. The free end 78 of the ejecting collar 72 may be aligned with or offset from an outer end 80 of the docking collar 68, so that the free end is positioned outside of the docking collar 68, when the ejecting collar 72 is in the extended position 76. The extended position 76 is configured to release the canister 60 from the collar 66.

A canister fastener 82 may be coupled to the housing 12. The canister fastener 82 fluidly couples the canister 60 to the chamber 22. The canister fastener 82 may comprise a tube 84 extending through the housing 12. An inlet end 86 of the tube 84 is generally aligned with the collar 66 and an outlet end 88 of the tube 84 is generally fluidly coupled to the chamber 22.

The canister fastener 82 may further include a pin 90 having a piercing end 92 and a mounting end 94. The mounting end 94 is coupled to the tube 84. The pin 90 extends outwardly from the tube 84 through the collar 66 wherein the collar 66 is in fluid communication with the tube 84 and wherein the collar 66 fluidly couples the canister 60 to the tube 84 when the collar 66 receives the canister 60. The pin 90 pierces the canister 60 when the canister 60 is coupled to the housing 12 whereby the canister 60 is in fluid communication with the tube 84 when the piercing end 92 is inserted into the canister 60. In other words, the piercing end 92 is inserted into the canister 60 when the canister 60 is mounted to the housing 12.

The ejecting collar 72 may extend outwardly from the housing 12 past the seal 70 and the outer end 80 of the docking collar 68 thereby covering the piercing end 92 of the pin 90 when the ejecting collar 72 is in the extended position 76. The ejecting collar 72 may retract inwardly toward the housing 12 thereby exposing the piercing end 92 of the pin 90 when the ejecting collar 72 is in the retracted position 74.

A cradle 96 is coupled to the housing 12. The cradle 96 has a shape that is complementary to a shape of the body 64 of the canister 60. The cradle 96 is configured to receive the body 64 of the canister 60. The cradle 96 is aligned with the collar 66. The cradle 96 is configured to facilitate coupling the canister 60 to the collar 66. The neck 62 of the canister 60 is couplable with the collar 66 when the body 64 of the canister 60 is positioned within the cradle 96.

In some embodiments, the cradle 96 further comprises a forward end 98 and a back end 100. The back end 100 is spaced from the forward end 98 so that the canister 60 is positionable between the forward end 98 and the back end 100. A panel 102 may extend between the forward end 98 and the back end 100. The panel 102 may have a pair of lateral sides 104. The panel 102 may be concavely arcuate between the pair of lateral sides 104 wherein the panel 102 has a shape that is complementary to the shape of the body 64 of the canister 60. Such embodiments are shown in FIGS. 1-8. In some embodiments, the cradle 96 may be positioned at the rear end 16 of the housing 12. In other embodiments, the cradle 96 may be positioned at the front end 14 of the housing 12.

Such embodiments may further comprise a locking mechanism 106 coupling the canister 60 to the housing 12. The locking mechanism 106 may include a stop 108 that is movably mounted to the stock 30. The stop 106 may extend downwardly from the stock 30 and being aligned with the back end 100 of the cradle 96. The stop 108 may move forward to secure the canister 60 to the cradle 96 and may move backward to release the canister 60 from the cradle 96.

The locking mechanism 106 may further include a locking lever 110 that is coupled to the housing 12. The locking lever 110 is actuatable between a locking position 112 and an ejecting position 114. The locking lever 110 may move the stop 108 forward toward the housing 12 when the locking lever 110 is in the locking position 112. The locking lever 110 may move the stop 108 backward away from the housing 12 when the locking lever 110 is in the ejecting position 114. The locking lever 110 may be positioned proximate to the rear end 16 so that it is convenient for the user to reach when the user is holding the air rifle device 10 by the grip 58 or the stock 30.

Figure 9:
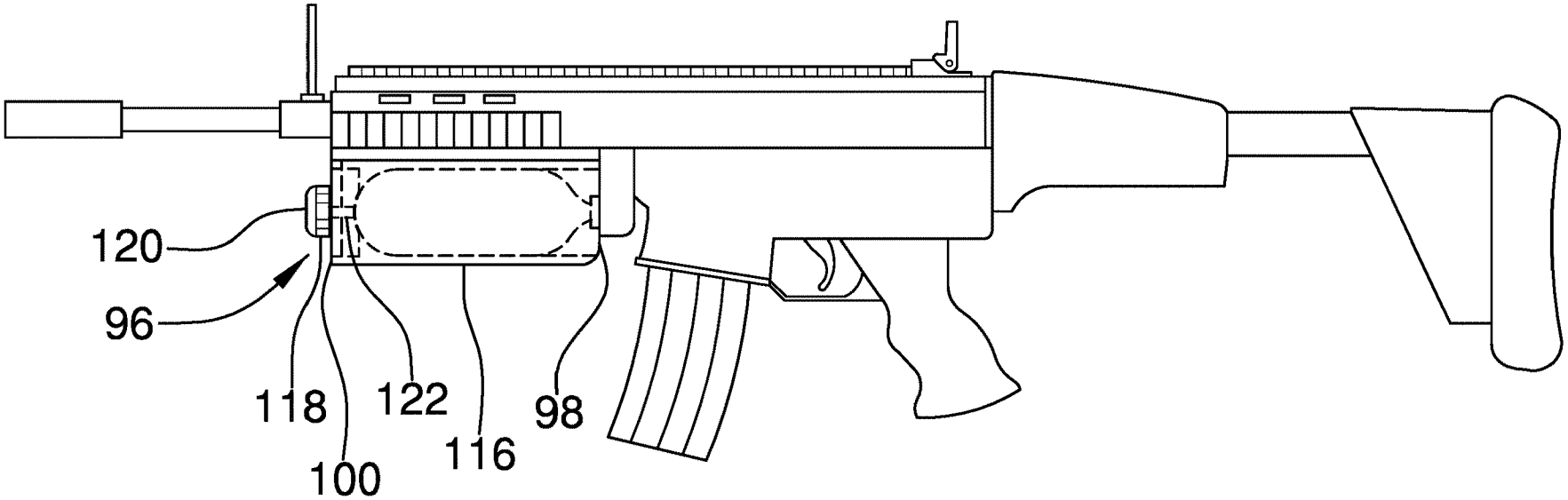
FIG. 9 is a front view of an embodiment of the disclosure.
Figure 10:
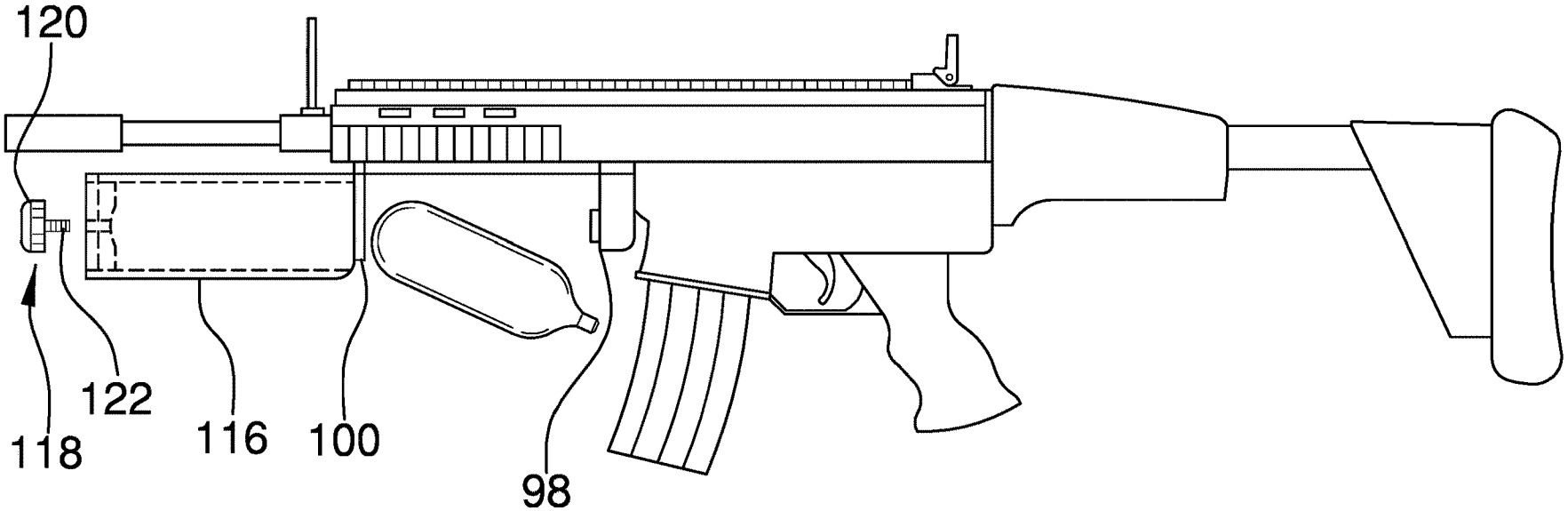
FIG. 10 is a front view of an embodiment of the disclosure.
Figure 11:
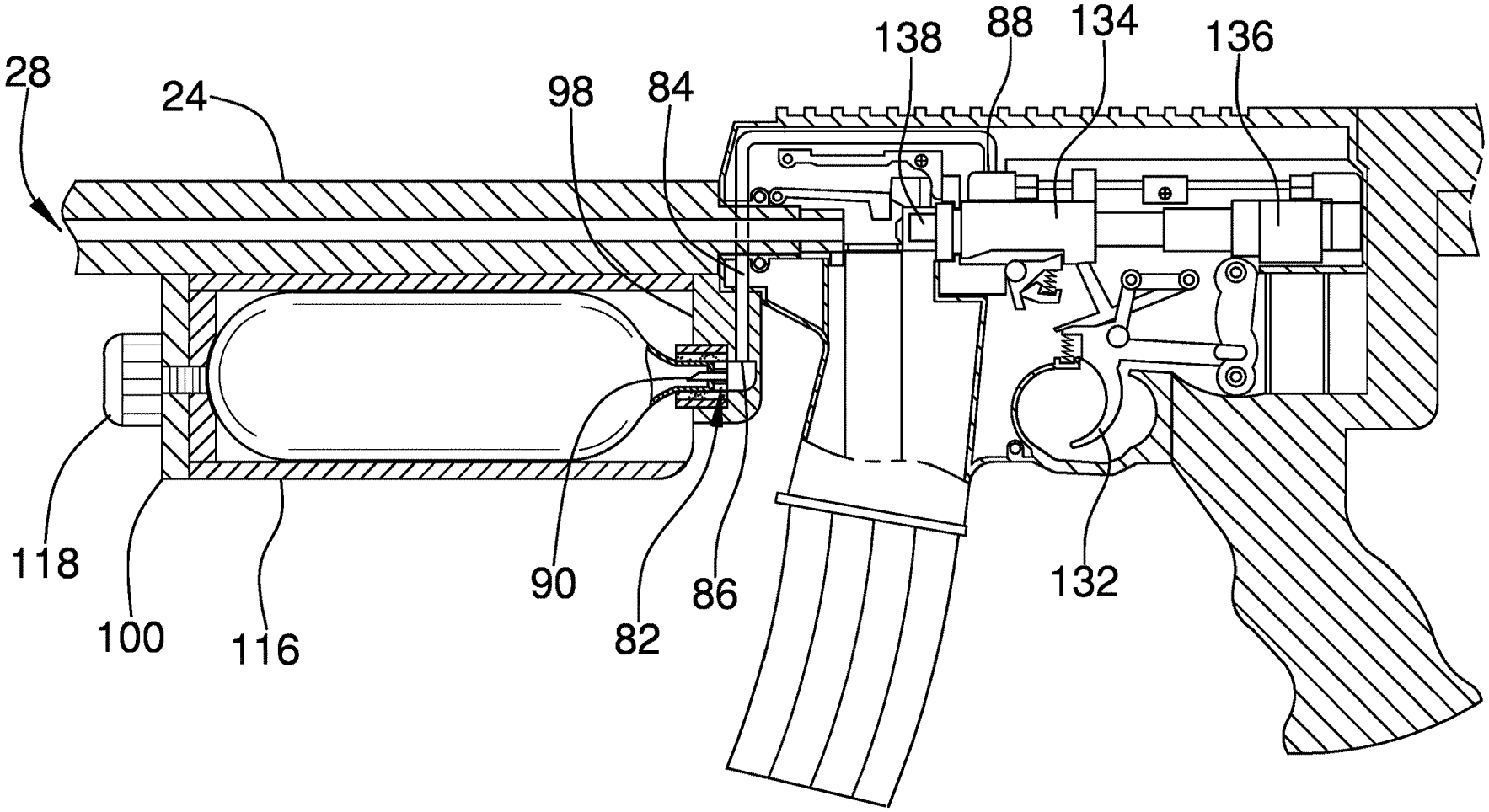
FIG. 11 is a cross-sectional view of an embodiment of the disclosure.

In other embodiments, such as those shown in FIGS. 9-11, the cradle 96 may further comprise a forward end 98 and a back end 100. The back end 100 is spaced from the forward end 98 and the canister 60 is positionable between the forward end 98 and the back end 100. A cover 116 may be slidably coupled to the back end 100. The cover 116 is positionable between the forward end 98 and the back end 100. The cover 116 slides outwardly away from the forward end 98 to facilitate positioning the canister 60 between the forward end 98 and the back end 100. The cover 116 slides inwardly toward the forward end 98 to facilitate securing the canister 60 to the housing 12.

A knob 118 may be coupled to the cover 116. The knob 118 generally includes a handle 120 and an arm 122. The arm 122 extends through the cover 116. Rotation of the handle 120 moves the arm 122 inwardly and outwardly along a transverse plane relative to the cover 116. The arm 122 contacts the canister 60 wherein the arm 122 secures the canister 60 within the cover 116 and facilitates coupling the canister 60 with the collar 66 when the arm 122 is moved inwardly. Like the embodiments shown in FIGS. 1-8, the embodiments shown in FIGS. 9-11 may have the cradle 96 positioned at the front end 14 or the rear end 16 of the housing 12.

A trigger mechanism 124 is mounted to the housing 12, for example being positioned adjacent to the grip 58. The trigger mechanism 124 expels a quantity of the propellant into the barrel 24. The quantity of the propellant is sufficient to propel the one of the plurality of projectiles 126 forwardly through the chamber 22 into the barrel 24 and outwardly through the muzzle end 26.

For example, the trigger mechanism 124 may comprise a trigger guard 128 that extends downwardly from the bottom side 20 and forwardly from the grip 58. The trigger guard 128 defines a trigger space 130 that is configured to receive a finger of the user. A trigger 132 is positioned within the trigger space 130. The trigger 132 is actuatable to release the quantity of the propellant into the chamber 22 thereby propelling the one of the plurality of projectiles 126 from the chamber 22 through the barrel 24 and outwardly through the muzzle end 26.

A hammer 134 may be coupled to the trigger 132. The hammer 134 is positioned within the chamber 22 and is aligned with the one of the plurality of projectiles 126 when the one of the plurality of projectiles 126 is positioned within the chamber 22.

A hammer spring 136 may be coupled to the hammer 134. The hammer spring 136 is generally positioned within the chamber 22 between the hammer 134 and the rear end 16. The hammer spring 136 may expand when the trigger 132 is actuated so that the hammer 134 moves outwardly from the hammer spring 136 to collide with the one of the plurality of projectiles 126 when the trigger 132 is actuated.

A valve 138 may be coupled to the hammer 134. The valve 138 is generally positioned in the chamber 22 and is fluidly coupled to the tube 84. The valve 138 is actuatable to release the quantity of propellent being expelled through the barrel 24 when the trigger 132 is actuated. The valve 138 is aligned with the barrel 24 and is generally positioned proximate to the front end 14 of the housing 12.

In use, the user can attach the canister 60 to the collar 66. The canister 60 holds the propellant that will propel the one of the plurality of projectiles 126 outwardly through the barrel 24 of the air rifle device 10. The user can generally shoot each of the plurality of projectiles 44 without needing to replace the canister 60 because the canister 60 generally has a large enough capacity to shoot each of the plurality of projectiles 44. To replace the canister 60, the user can disconnect the canister 60 from the collar 66, for example by moving the ejecting collar 72 to the extended position 76 and decoupling the canister 60 from the cradle 96.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An air rifle assembly comprising:

a housing having a front end, a rear end, a top side, and a bottom side, the top side and the bottom side being coupled to and extending between the front end and the rear end to define a chamber extending through the housing;

a barrel being coupled to the front end, the barrel having a muzzle end distal to the front end of the housing, the muzzle end defining an opening extending into the barrel, the chamber being in fluid communication with the barrel;

a clip being removably couplable to the housing, the clip being in fluid communication with the chamber, the clip housing a plurality of projectiles;

a canister being removably mounted to the housing, the canister being fluidly couplable to the chamber, the canister housing a propellant, the canister having a capacity between 20.0 grams and 70.0 grams, the canister comprising a neck and a body;

a collar being mounted to the housing, the collar being configured to receive the neck of the canister, the collar including:

a docking collar being positioned on the bottom side of the housing;

a seal being coupled to the docking collar, the seal being positioned within the docking collar, the seal sealing the canister with the housing thereby inhibiting the propellant from being released from the canister through the collar; and an ejecting collar being positioned within the seal, the ejecting collar having a retracted position and an extended position, wherein the retracted position is configured to couple the canister to the collar, wherein the extended position is configured to release the canister from the collar;

a canister fastener being coupled to the housing, the canister fastener fluidly coupling the canister to the chamber, the canister fastener including:

a tube extending through the housing;

a pin having a piercing end and a mounting end, the mounting end being coupled to the tube, the pin extending outwardly from the tube through the collar wherein the collar is in fluid communication with the tube wherein the collar fluidly couples the canister to the tube when the collar receives the canister, the pin piercing the canister when the canister is coupled to the housing whereby the canister is in fluid communication with the tube when the piercing end is inserted into the canister, the piercing end being inserted into the canister when the canister is mounted to the housing;

wherein the ejecting collar extends outwardly past the seal thereby covering the piercing end of the pin when the ejecting collar is in the extended position; and wherein the ejecting collar retracts inwardly toward the housing thereby exposing the piercing end of the pin when the ejecting collar is in the retracted position;

a cradle being coupled to the housing, the cradle having a shape being complementary to a shape of the body of the canister wherein the cradle is configured to receive the canister, the cradle being aligned with the collar wherein the cradle is configured to facilitate coupling the canister to the collar whereby the neck of the canister is couplable with the collar when the body of the canister is positioned within the cradle; and a trigger mechanism being mounted to the housing, the trigger mechanism expelling a quantity of the propellant into the barrel, the quantity of the propellant being sufficient to propel a one of the plurality of projectiles forwardly through the chamber into the barrel and outwardly through the muzzle end.

2. The air rifle assembly of claim 1, further comprising a stock being coupled to the housing, the stock being configured to abut a user for steadying the housing and the barrel.

3. The air rifle assembly of claim 1, further comprising a scope being mounted to the housing, the scope being configured to align the front end with the rear end wherein the scope is configured to align the muzzle end with a target when the barrel is aimed at the target.

4. The air rifle assembly of claim 3, the scope further comprising:

a front sight extending upwardly from the top side; and a rear sight extending upwardly from the top side, the rear sight being spaced from the front sight.

5. The air rifle assembly of claim 1, wherein each of the plurality of projectiles is between 20 caliber and 40 caliber.

6. The air rifle assembly of claim 1, wherein each of the plurality of projectiles has a weight between 65.0 grain and 135.0 grain.

7. The air rifle assembly of claim 1, the clip further comprising:

a first magazine having an upper end being positionable within the chamber; and a second magazine being coupled to the upper end, the second magazine having an inner recess being configured to receive the plurality of projectiles, wherein the plurality of projectiles are stacked on top of each other along a longitudinal plane within the inner recess;

a pellet spring being positioned within the inner recess proximate to the upper end of the first magazine, the pellet spring being compressed by a weight of the plurality of projectiles, the pellet spring expanding as each of the plurality of projectiles is propelled outwardly from the barrel wherein the pellet spring urges the plurality of projectiles upwardly toward the chamber.

8. The air rifle assembly of claim 1, the trigger mechanism further comprising:

a trigger guard extending downwardly from the bottom side, the trigger guard defining a trigger space, the trigger space being configured to receive a finger of a user;

a trigger being positioned within the trigger space, the trigger being actuatable to release the quantity of the propellant into the chamber thereby propelling the one of the plurality of projectiles from the chamber through the barrel and outwardly through the muzzle end;

a hammer being coupled to the trigger, the hammer being positioned within the chamber and being aligned with the one of the plurality of projectiles when the one of the plurality of projectiles is positioned within the chamber;

a hammer spring being coupled to the hammer, the hammer spring being positioned within the chamber between the hammer and the rear end, the hammer spring expanding when the trigger is actuated wherein the hammer moves outwardly from the hammer spring to collide with the one of the plurality of projectiles when the trigger is actuated; and a valve being coupled to the hammer, the valve being positioned in the chamber, the valve being actuatable to release the quantity of propellent being expelled through the barrel when the trigger is actuated.

9. The air rifle assembly of claim 1, wherein the propellant is carbon dioxide.

10. The air rifle assembly of claim 1, wherein the canister is a pneumatic cylinder of carbon dioxide.

11. The air rifle assembly of claim 1, the cradle further comprising:

a forward end and a back end, the back end being spaced from the forward end wherein the canister is positionable between the forward end and the back end; and a panel extending between the forward end and the back end, the panel having a pair of lateral sides, the panel being concavely arcuate between the pair of lateral sides wherein the panel has a shape being complementary to the shape of the body of the canister.

12. The air rifle assembly of claim 11, further comprising a locking mechanism coupling the canister to the housing, the locking mechanism including:

a stop being movably mounted to the housing, the stop being aligned with the back end of the cradle, the stop moving forward to secure the canister to the cradle, the stop moving backward to release the canister from the cradle; and a locking lever being coupled to the housing, the locking lever being actuatable between a locking position and an ejecting position, the locking lever moving the stop forward toward the housing when the locking lever is in the locking position, the locking lever moving the stop backward away from the housing when the locking lever is in the ejecting position.

13. The air rifle assembly of claim 1, the cradle further comprising:

a forward end and a back end, the back end being spaced from the forward end wherein the canister is positionable between the forward end and the back end; and a cover being slidably coupled to the back end, the cover being positionable between the forward end and the back end, the cover sliding outwardly away from the forward end to facilitate positioning the canister between the forward end and the back end, the cover sliding inwardly toward the forward end to facilitate securing the canister to the housing.

14. The air rifle assembly of claim 13, the cradle further comprising a knob being coupled to the cover, the knob including a handle and an arm, the arm extending through the cover wherein rotation of the handle moves the arm inwardly and outwardly along a transverse plane relative to the cover, the arm contacting the canister wherein the arm secures the canister within the cover and facilitates coupling the canister with the collar when the arm is moved inwardly.

15. An air rifle assembly comprising:

a housing having a front end, a rear end, a top side, and a bottom side, the top side and the bottom side being coupled to and extending between the front end and the rear end to define a chamber extending through the housing;

a barrel being coupled to the front end, the barrel having a muzzle end distal to the front end of the housing, the muzzle end defining an opening extending into the barrel, the chamber being in fluid communication with the barrel, the barrel extending outwardly from the front end;

a stock being coupled to the housing, the stock being configured to abut a user for steadying the housing and the barrel;

a recoil pad being coupled to the stock distal to the housing, the recoil pad being configured to absorb recoil and increase friction between the stock and a shoulder of the user when the barrel is aimed at a target;

a scope being mounted to the housing, the scope being configured to align the front end with the rear end wherein the scope is configured to align the muzzle end with the target when the barrel is aimed at the target, the scope comprising:

a front sight extending upwardly from the front end, the front sight being positioned proximate to the barrel;

a rear sight extending upwardly from the rear end, the rear sight being positioned proximate to the stock;

a rail extending along the top side of the housing between the front sight and the rear sight, the rail being configured to receive a scope mount;

a clip being removably couplable to the housing, the clip being in fluid communication with the chamber, the clip extending downwardly from the bottom side of the housing, the clip housing a plurality of projectiles, each of the plurality of projectiles being 30 caliber, and having a weight between 65.0 grain and 135.0 grain, the clip including:

a first magazine having an upper end being positionable within the chamber;

a second magazine being coupled to the upper end, the second magazine having an inner recess being configured to receive the plurality of projectiles, wherein the plurality of projectiles are stacked on top of each other along a longitudinal plane within the inner recess;

a pellet spring being positioned within the inner recess proximate to the upper end of the first magazine, the pellet spring being compressed by a weight of the plurality of projectiles, the pellet spring expanding as each of the plurality of projectiles is propelled outwardly from the barrel wherein the pellet spring urges the plurality of projectiles upwardly toward the chamber;

a cocking lever being coupled to the housing, the cocking lever being actuatable to release a one of the plurality of projectiles into the chamber, the one of the plurality of projectiles being aligned with the barrel when the one of the plurality of projectiles is released from the second magazine into the chamber;

a grip extending downwardly from the bottom side of the housing, the grip being configured to facilitate the user in holding the housing, the grip being positioned proximate to the rear end;

a canister being removably mounted to the housing, the canister being fluidly couplable to the chamber, the canister housing a propellant, the propellant being carbon dioxide, the canister being a pneumatic cylinder of the carbon dioxide, the canister having a capacity between 30.0 grams and 60.0 grams, the canister comprising a neck and a body;

a collar being mounted to the housing, the collar being configured to receive the neck of the canister, the collar comprising:

a docking collar being positioned on the bottom side of the housing;

a seal being coupled to the docking collar, the seal being positioned within the docking collar, the seal sealing the canister with the housing thereby inhibiting the propellant from being released from the canister through the collar;

an ejecting collar being positioned within the seal, the ejecting collar having a retracted position and an extended position, wherein the retracted position is configured to couple the canister to the collar, wherein the extended position is configured to release the canister from the collar;

a canister fastener being coupled to the housing, the canister fastener fluidly coupling the canister to the chamber, the canister fastener comprising:

a tube extending through the housing;

a pin having a piercing end and a mounting end, the mounting end being coupled to the tube, the pin extending outwardly from the tube through the collar wherein the collar is in fluid communication with the tube wherein the collar fluidly couples the canister to the tube when the collar receives the canister, the pin piercing the canister when the canister is coupled to the housing whereby the canister is in fluid communication with the tube when the piercing end is inserted into the canister, the piercing end being inserted into the canister when the canister is mounted to the housing;

wherein the ejecting collar extends outwardly past the seal thereby covering the piercing end of the pin when the ejecting collar is in the extended position;

wherein the ejecting collar retracts inwardly toward the housing thereby exposing the piercing end of the pin when the ejecting collar is in the retracted position;

a cradle being coupled to the housing, the cradle having a shape being complementary to a shape of the body of the canister wherein the cradle is configured to receive the canister, the cradle being aligned with the collar wherein the cradle is configured to facilitate coupling the canister to the collar whereby the neck of the canister is couplable with the collar when the body of the canister is positioned within the cradle;

a trigger mechanism being mounted to the housing adjacent to the grip, the trigger mechanism expelling a quantity of the propellant into the barrel, the quantity of the propellant being sufficient to propel the one of the plurality of projectiles forwardly through the chamber into the barrel and outwardly through the muzzle end, the trigger mechanism comprising:

a trigger guard extending forwardly from the grip, the trigger guard defining a trigger space, the trigger space being configured to receive a finger of the user;

a trigger being positioned within the trigger space, the trigger being actuatable to release the quantity of the propellant into the chamber thereby propelling the one of the plurality of projectiles from the chamber through the barrel and outwardly through the muzzle end;

a hammer being coupled to the trigger, the hammer being positioned within the chamber and being aligned with the one of the plurality of projectiles when the one of the plurality of projectiles is positioned within the chamber;

a hammer spring being coupled to the hammer, the hammer spring being positioned within the chamber between the hammer and the rear end, the hammer spring expanding when the trigger is actuated wherein the hammer moves outwardly from the hammer spring to collide with the one of the plurality of projectiles when the trigger is actuated; and a valve being coupled to the hammer, the valve being positioned in the chamber, the valve being fluidly coupled to the tube, the valve being actuatable to release the quantity of propellent being expelled through the barrel when the trigger is actuated, the valve being aligned with the barrel, the valve being positioned proximate to the front end of the housing.

16. The air rifle assembly of claim 15, the cradle further comprising:

a forward end and a back end, the back end being spaced from the forward end wherein the canister is positionable between the forward end and the back end;

a panel extending between the forward end and the back end, the panel having a pair of lateral sides, the panel being concavely arcuate between the pair of lateral sides wherein the panel has a shape being complementary to the shape of the canister; and wherein the cradle is positioned at the rear end of the housing.

17. The air rifle assembly of claim 16, further comprising a locking mechanism coupling the canister to the housing, the locking mechanism including:

a stop being movably mounted to the stock, the stop extending downwardly from the stock and being aligned with the back end of the cradle, the stop moving forward to secure the canister to the cradle, the stop moving backward to release the canister from the cradle; and a locking lever being coupled to the housing, the locking lever being actuatable between a locking position and an ejecting position, the locking lever moving the stop forward toward the housing when the locking lever is in the locking position, the locking lever moving the stop backward away from the housing when the locking lever is in the ejecting position, the locking lever being positioned proximate to the rear end.

18. The air rifle assembly of claim 15, the cradle further comprising:

a forward end and a back end, the back end being spaced from the forward end wherein the canister is positionable between the forward end and the back end;

a cover being slidably coupled to the back end, the cover being positionable between the forward end and the back end, the cover sliding outwardly away from the forward end to facilitate positioning the canister between the forward end and the back end, the cover sliding inwardly toward the forward end to facilitate securing the canister to the housing;

a knob being coupled to the cover, the knob including a handle and an arm, the arm extending through the cover wherein rotation of the handle moves the arm inwardly and outwardly along a transverse plane relative to the cover, the arm contacting the canister wherein the arm secures the canister within the cover and facilitates coupling the canister with the collar when the arm is moved inwardly; and wherein the cradle is positioned at the front end of the housing.

* * * * *